US009194323B2

(12) United States Patent
Yarino et al.

(10) Patent No.: US 9,194,323 B2
(45) Date of Patent: Nov. 24, 2015

(54) FUEL INJECTION DEVICE

(75) Inventors: Motonari Yarino, Susono (JP); Tatsuo Kobayashi, Susono (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 292 days.

(21) Appl. No.: 14/001,718

(22) PCT Filed: Mar. 31, 2011

(86) PCT No.: PCT/JP2011/058269

§ 371 (c)(1),
(2), (4) Date: Aug. 27, 2013

(87) PCT Pub. No.: WO2012/131996

PCT Pub. Date: Oct. 4, 2012

(65) Prior Publication Data

US 2014/0014069 A1 Jan. 16, 2014

(51) Int. Cl.
*F02B 43/00* (2006.01)
*F02D 41/30* (2006.01)
(Continued)

(52) U.S. Cl.
CPC ..... *F02D 41/30* (2013.01); *F02M 61/1873* (2013.01); *F02D 2200/0602* (2013.01); *F02D 2200/0606* (2013.01); *F02M 53/00* (2013.01); *F02M 61/163* (2013.01); *F02M 61/182* (2013.01); *F02M 67/04* (2013.01); *F02M 69/047* (2013.01); *F02M 2700/077* (2013.01); *F02M 2700/126* (2013.01)

(58) Field of Classification Search
CPC ..... F02M 21/02
USPC ..... 123/479, 457, 458, 446, 527, 27 GE
See application file for complete search history.

(56) References Cited

U.S. PATENT DOCUMENTS 4,955,345 A * 9/1990 Brown ..... F02D 41/0025 123/381
5,291,869 A * 3/1994 Bennett ..... F02M 69/465 123/41.31

(Continued)

FOREIGN PATENT DOCUMENTS

DE 19712112 A1 9/1998
JP 60-108548 A 6/1985

(Continued)

OTHER PUBLICATIONS

International Search Report of PCT/JP2011/058269 dated May 24, 2011.

(Continued)

*Primary Examiner* — John Kwon
(74) *Attorney, Agent, or Firm* — Sughrue Mion, PLLC

(57) ABSTRACT

A fuel injection device is equipped with a fuel injection valve that is mounted in an engine body and injects fuel containing air bubbles, and void fraction adjustment means that changes a void fraction of the fuel that is to be injected from the fuel injection valve. The void ratio adjustment means increases the fuel pressure of the fuel to be injected from the fuel injection valve when an increase of the void fraction is requested. The void fraction adjustment means adjusts the void fraction of the fuel by changing temperature of the fuel to be injected from the fuel injection valve. By appropriately controlling the void fraction, both fuel atomization and securement of the net amount of fuel can be achieved.

11 Claims, 11 Drawing Sheets

(51) Int. Cl.

| | |
|---|---|
| ***F02M 61/18*** | (2006.01) |
| *F02M 53/00* | (2006.01) |
| *F02M 61/16* | (2006.01) |
| *F02M 67/04* | (2006.01) |
| *F02M 69/04* | (2006.01) |

(56) References Cited

U.S. PATENT DOCUMENTS

| | | | | |
|---|---|---|---|---|
| 2005/0257775 | A1* | 11/2005 | Kojima | F01N 3/20 123/458 |
| 2006/0131447 | A1 | 6/2006 | Masuda et al. | |

FOREIGN PATENT DOCUMENTS

| | | | |
|---|---|---|---|
| JP | 60156972 | A | 8/1985 |
| JP | 02-259272 | A | 10/1990 |
| JP | 10-141183 | A | 5/1998 |
| JP | 10-331689 | A | 12/1998 |
| JP | 2001-336439 | A | 12/2001 |
| JP | 2003307165 | A | 10/2003 |
| JP | 2006-177174 | A | 7/2006 |
| JP | 2010-112269 | A | 5/2010 |
| JP | 2010-112270 | A | 5/2010 |
| JP | 2010-255458 | A | 11/2010 |
| WO | 2012/086005 | A1 | 6/2012 |

OTHER PUBLICATIONS

Communication dated Mar. 25, 2015 from the European Patent Office in counterpart application No. 11862040.0.

* cited by examiner

MAP FOR TARGET VOID FRACTION (FOR USE IN LOW WATER TEMPERATURE)

MAP FOR TARGET VOID FRACTION (FOR USE IN HIGH WATER TEMPERATURE)

MAP FOR BASE FUEL PRESSURE

RELATION BETWEEN COOLING WATER TEMPERATURE AND FUEL TEMPERATURE WHEN THE FUEL INJECTION AMOUNT IS FIXED

RELATION BETWEEN FUEL TEMPERATURE AND VOID FRACTION FOR DIFFERENT FUEL FLOW RATES

MAP FOR CALCULATING FUEL TEMPERATURE

FUEL TEMPERATURE IN IN-CYLINDER FUEL INJECTION VALVE (IN A CASE WHERE PORT INJECTION RATIO (kpfi) IS LOW)

FUEL TEMPERATURE IN IN-CYLINDER FUEL INJECTION VALVE (IN A CASE WHERE PORT INJECTION RATIO (kpfi) IS HIGH)

RELATION BETWEEN FUEL
PRESSURE AND VOID FRACTION

FUEL INJECTION DEVICE

CROSS REFERENCE TO RELATED APPLICATIONS

This is a National Stage of International Application No. PCT/JP2011/058269 filed Mar. 31, 2011, the content of all of which is incorporated herein by reference in its entirety.

TECHNICAL FIELD

The present invention relates to fuel injection devices.

BACKGROUND ART

Recently, there has been a considerable activity in the researches of boosted lean, a large-amount-of-EGR and homogeneous-charge self-ignition combustion of internal combustion engines for the purpose of reducing $CO_2$ and emission. According to these researches, in order to maximize the results of $CO_2$ reduction and emission reduction, it is necessary to realize a stable combustion state near the combustion limit. Also, petroleum fuel is being depleted, and robustness in stable combustion with a variety of fuel such as biofuel is required. The most important factor for realizing the stable combustion is to reduce differences in ignition of mixture and speedy combustion in which fuel is completely burned in the expansion stroke.

Also, a fuel supply of the internal combustion engine adopts an in-cylinder injection system in which fuel is injected directly in a combustion chamber for the purpose of improving the transient responsibility and the volume efficiency by evaporation latent heat and carrying out greatly retarded combustion for catalyst activation at low temperatures. However, the adoption of the in-cylinder injection system accelerates considerable oil dilution caused when spray fuel hits the wall of the combustion chamber as the spray fuel is in the form of liquid droplets and to considerable variations in combustion due to spray deterioration resulting from deposits grown around an injection aperture of the fuel valve with liquid fuel.

It is important to atomize the spray for realizing speedy evaporation of fuel in the combustion chamber in order to prepare for the oil dilution and the spray deterioration and to reduce the differences in ignition and realize stable combustion.

As ways to atomize the spray injected from the fuel injection valve, there are known an atomization by shearing force in a liquid film obtained in such a manner that the spray is formed into a thin film, an atomization by cavitation that occurs in removal of a flow, and an atomization of fuel deposited on a surface by mechanical vibrations of ultrasonic wave.

Patent Document 1 discloses a fuel injection valve in which the area of the cross section of a flow path in a bubble holding flow path is made larger than the cross section of a cavitation generating flow path, whereby the flow outlet of the cavitation generating flow path has a rapidly expanding flow. This fuel injection valve generates cavitation in the bubble holding flow path by designing the flow output of the cavitation generating flow path to have a rapidly expanding flow. As described above, various fuel injection valves that generate cavitation inside are proposed.

PRIOR ART DOCUMENTS

Patent Documents

Japanese Patent Application Publication No. 10-141183

SUMMARY OF THE INVENTION

Problems to be Solved by the Invention

However, the fuel injection valve used for the in-cylinder injection is likely to be affected by heat of combustion. In the case where the cavitation is generated in the fuel injection valve as described in Patent Document 1, if the fuel injection valve that injects fuel containing bubbles is affected by heat, the bubbles contained in the fuel expand, and the ratio of bubbles in fuel (void fraction) is likely to adversely rise. That is, the bubbles (gas) have a higher volume expansion coefficient than the liquid, and trends to have a higher void fraction as the fuel temperature is higher. As a result, under a high-temperature environment, the flow rate of fuel decreases and the amount of fuel injection necessary for combustion may not be secured appropriately.

Accordingly, the present invention aims at atomizing fuel and securing a net amount of fuel in a fuel injection valve that injects fuel containing bubbles.

Means for Solving the Problems

The fuel injection device for solving the problems disclosed in the description is equipped with a fuel injection valve that is mounted in an engine body and injects fuel containing air bubbles; and void fraction adjustment means that changes a void fraction of the fuel that is to be injected from the fuel injection valve. By changing the void fraction, it is possible to realize atomization of fuel and simultaneously secure the net fuel amount.

The void ratio adjustment means increases fuel pressure of the fuel to be injected from the fuel injection valve when an increase of the void fraction is requested. By increasing the void fraction, atomization of fuel is accelerated. For example, a case where atomization of fuel is highly requested as in the case of low water temperatures corresponds to a case where an increase in the void fraction is requested. Since the void fraction is increased by increasing he fuel pressure, the atomization of fuel can be accelerated by increasing the fuel pressure when an increase in the void fraction is requested.

The void fraction adjustment means adjusts the void fraction of the fuel by changing temperature of the fuel to be injected from the fuel injection valve. The void fraction changes in accordance with the temperature of fuel. Therefore, by changing the temperature of fuel, the void fraction can be controlled. The void fraction adjustment means is capable of increasing the temperature of fuel to be injected from the fuel injection valve when an increase in the void fraction is requested.

The void fraction adjustment means adjusts the void fraction by adjusting the temperature of the fuel to be injected from the fuel injection valve in accordance with the temperature of fuel in each cylinder of the engine body. Normally, the fuel to be injected from the fuel injection valve that is farther away from a fuel pump that pressurizes the fuel to the fuel injection valve trends to have a higher temperature because the fuel receives heat in that path for a longer time. If there are differences in the fuel temperature between the fuel injection valves, a case may occur where the fuel injection valves have different void fractions. With the above in mind, by adjusting the temperature of the fuel injection valve for each cylinder, it is possible to suppress differences in the fuel injection between the cylinders.

The fuel injection valve includes an in-cylinder fuel injection valve and a port fuel injection valve, and the void fraction adjustment means adjusts the temperature of the fuel to be injected from the in-cylinder fuel injection valve by changing an injection ratio between the in-cylinder fuel injection valve and the port fuel injection valve. An increased amount of fuel to be injected is capable of reducing the fuel temperature due to the cooling effect and heat capacity of the fuel. By controlling the fuel temperature in this manner, the void fraction can be adjusted.

The void fraction adjustment means can increase the injection ratio of the port fuel injection valve when the temperature of cooling water supplied to the engine body is lower than a predetermined threshold vale. The adjustment of the void fraction is preferably carried out after the engine body is completely warmed up to become the stable working state. An increased ratio of injection from the port fuel injection valve results in a decreased ratio of injection from the in-cylinder fuel injection valve, and leads to a smaller fuel effect by fuel. As a result, the temperature of fuel to be injected from the in-cylinder fuel injection valve becomes higher, and the warm-up of the engine body is accelerated.

Effects of the Invention

According to the fuel injection device disclosed in the description, it is possible to realize fuel atomization and secure the net fuel amount in the fuel injection valve that injects fuel containing air bubbles.

MODES FOR CARRYING OUT THE EMBODIMENTS

Figure 1:
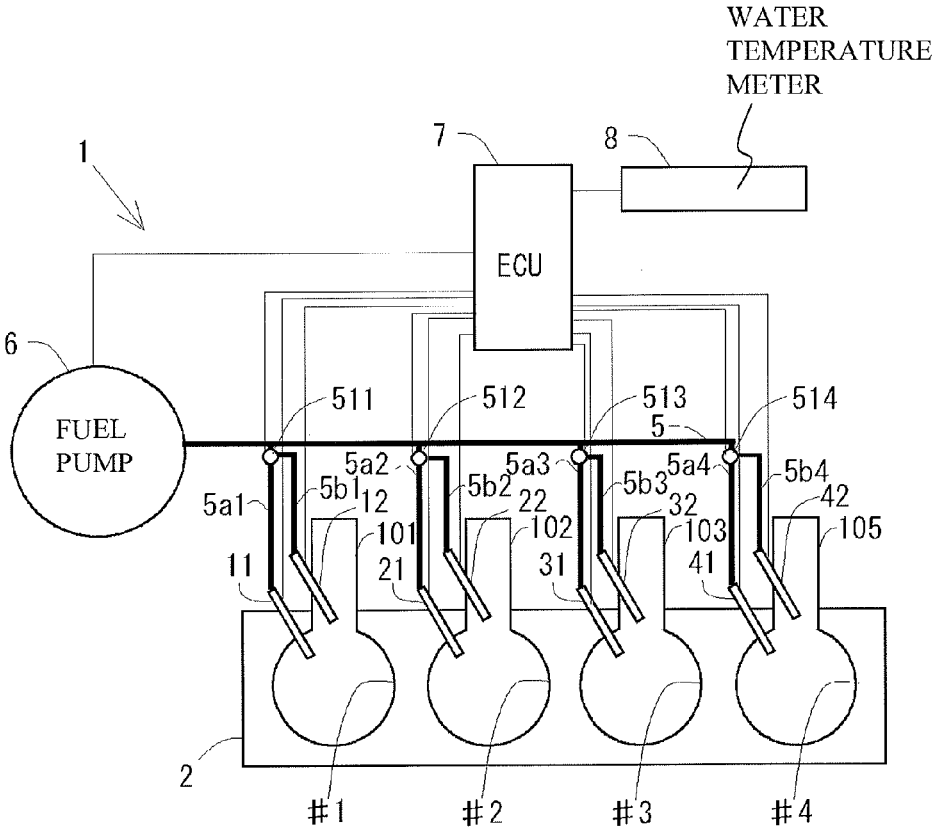
FIG. 1 is a descriptive diagram of an exemplary structure of a fuel injection device mounted in an engine body.

Now, modes for carrying out the embodiments are described in detail with reference to the drawings. In the drawings, there are cases where the sizes and ratios of parts and the like are not illustrated so as to completely correspond to the real ones. Further, some drawings may have omission of small parts.

Embodiment 1

A description is given, with reference to the drawings, of Embodiment 1 of the present invention. FIG. 1 is a descriptive diagram of an exemplary structure of a fuel injection device 1 mounted in an engine body 2. The engine body 2 has a first cylinder #1~a fourth cylinder #4. The first cylinder #1~the fourth cylinder #4 are respectively equipped with a first intake port 101~a fourth intake port 104. The fuel injection device 1 has, as fuel injection valves for supplying fuel to the first cylinder #1, a first in-cylinder fuel injection valve 11 and a first-port fuel injection valve 12. The fuel injection device 1 has, as fuel injection valves for supplying fuel to the second cylinder #2, a second in-cylinder fuel injection valve 21 and a second-port fuel injection valve 22. The fuel injection device 1 has, as fuel injection valves for supplying fuel to the third cylinder #3, a third in-cylinder fuel injection valve 31 and a third-port fuel injection valve 32. The fuel injection device 1 has, as fuel injection valves for supplying fuel to the fourth cylinder #4, a fourth in-cylinder fuel injection valve 41 and a fourth-port fuel injection valve 42.

The in-cylinder fuel injection valves 11, 21, 31 and 41 are respectively connected to first branch pipes 5*a*1~5*a*4 that branch from a delivery pipe 5 connected to a fuel pump 6. The port fuel injection valves 12, 22, 32 and 42 are respectively connected to second branch pipes 5*b*1~5*b*4 that branch from the first branch pipes 5*a*1~5*a*4. A first adjustment valve 511 is provided at the branching point of the second branch pipe 5*b*1. A second adjustment valve 512 is provided at the branching point of the second branch pipe 5*b*2. A third adjustment valve 513 is provided at the branching point of the second branch pipe 5*b*3. A fourth adjustment valve 514 is provided at the branching point of the second branch pipe 5*b*4. The first adjustment valve 511~the fourth adjustment valve 514 change the injection ratio between the in-cylinder fuel injection valve and the port fuel injection valve. In the following description, the ratio of the port fuel injection valve to the in-cylinder fuel injection valve may be referred to as port injection ratio.

The fuel injection device 1 is equipped with an ECU 7 as a control part. The ECU 7 is a computer having a CPU (Central Processing Unit) performing arithmetic processing, a ROM (Read Only Memory) storing programs and so on, a RAM (Random Access Memory) and NVRAM (Non Volatile RAM) storing data or the like. The ECU 7 is electrically connected to the in-cylinder fuel injection valves 11, 21, 31 and 41. The ECU 7 is electrically connected to the port fuel injection valves 12, 22, 32 and 42. The ECU 7 is electrically connected to the first adjustment valve 511~the fourth adjustment valve 514. The ECU 7 is electrically connected to the fuel pump 6 and is capable of controlling the duty ratio of the fuel pump 6. Various sensors for controlling the working states of the engine body are connected to the ECU 7, and a water temperature meter 8. The fuel pump 6 is provided closest to the first cylinder #1, and is furthest from the fourth cylinder #4.

The ECU 7, which adjusts the fuel pressure by controlling the duty ratio of the fuel pump 6 and performing an opening/closing control of the first adjustment valve 511~the fourth adjustment valve 514, has a function of void fraction adjustment means. That is, the ECU 7 changes the void fraction of fuel that is to be injected from the fuel injection valves, particularly, the in-cylinder fuel injection valves by controlling the duty ratio of the fuel pump 6 and controlling the temperature of fuel by the opening/closing control of the first adjustment valve 511 through the fourth adjustment valve 514.

Figure 2:
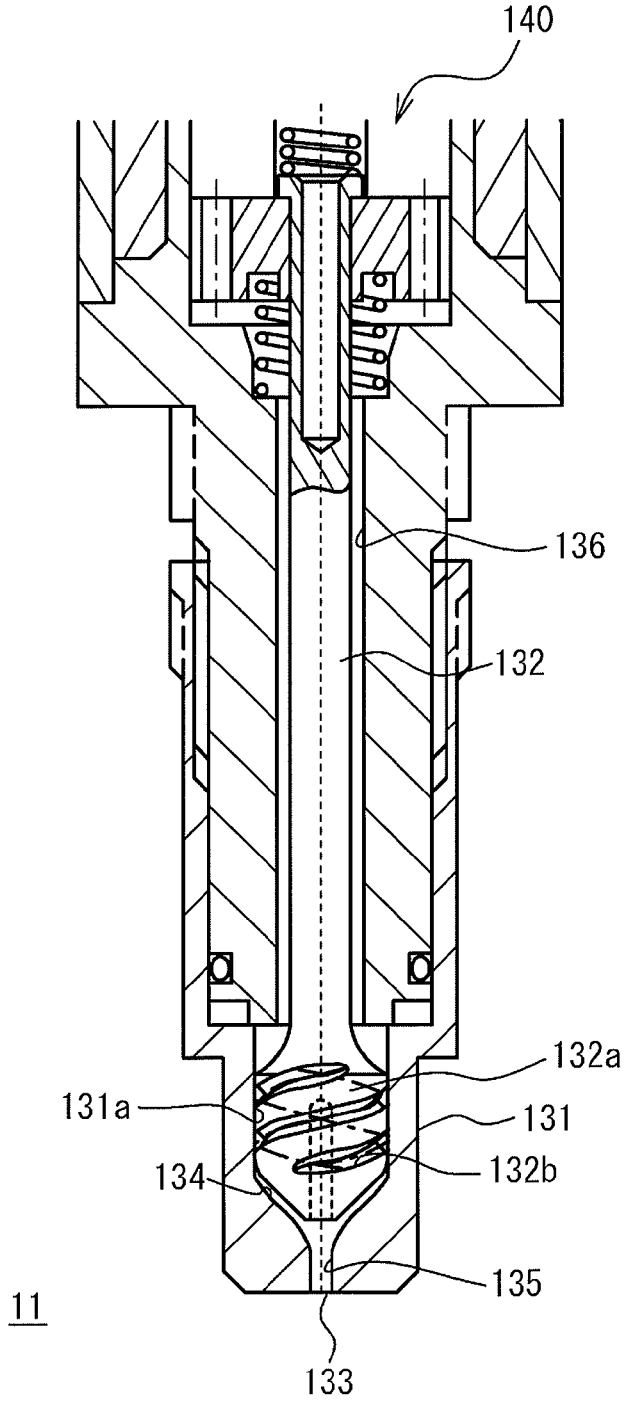
FIG. 2 is a descriptive view of a cross-section of main parts of an in-cylinder fuel injection valve included in a fuel injection device of Embodiment 1.
Figure 3:
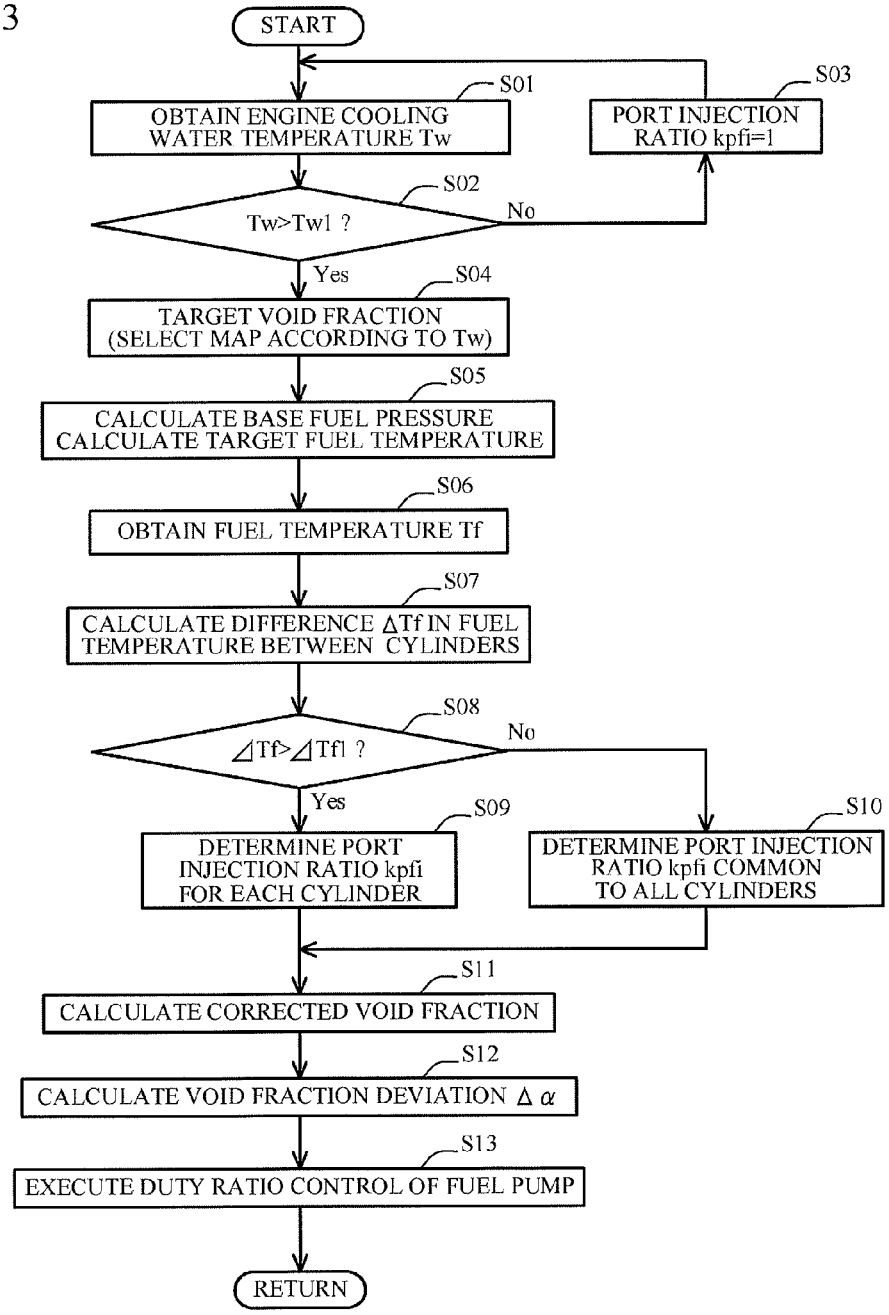
FIG. 3 is a flow chart of an exemplary control carried out in the fuel injection device.

The in-cylinder fuel injection valves 11, 21, 31 and 41 are capable of injecting fuel containing air bubbles. FIG. 2 is a descriptive view of a cross section of main parts of the in-cylinder fuel injection valve 11 contained in the fuel injection device of Embodiment 1. Since the in-cylinder fuel injection valves 11, 21, 31 and 41 are the same as each other, and only the first in-cylinder fuel injection valve 11 is described here.

The in-cylinder fuel injection valve 11 has a nozzle body 131, a needle 132, and a drive mechanism 140. The drive mechanism 140 controls a slide operation of the needle 132. The drive mechanism 140 is a conventionally known mechanism composed of parts necessary for operating the needle 132, such as an actuator using a piezoelectric element or an electric magnet, and a resilient member that applies appropriate pressure to the needle 132. In the following description, an extremity side indicates the lower side of the figure, and a base side indicates the upper side thereof.

An injection aperture 133 is provided at the extremity of the nozzle body 131. The injection aperture 133 is a single aperture formed in the direction of the axis of the nozzle body 131 in the extremity thereof. A seat portion 134 on which the needle 132 seats is formed inside the nozzle body 131. The needle 132 is arranged so as to be free to slide in the nozzle body 131, and defines a fuel introduction path 136 between the needle 132 and the nozzle body 131. When the needle 132 seats on the seat portion 134 in the nozzle body 131, the in-cylinder fuel injection valve 130 is in the closed state. When the needle 132 is lifted up by the drive mechanism 140 and is removed from the seat portion 134, the in-cylinder fuel injection valve 11 is in the open state. The seat portion 134 is located in a deep position from the injection aperture 133. Thus, the injection aperture 133 communicates with the outside irrespective of whether the needle 132 is in the open state or in the closed state. In a case where the in-cylinder fuel injection valve 11 is attached so as to be exposed to the combustion chamber of the engine body 1, the injection aperture 133 communicates with the combustion chamber.

The in-cylinder fuel injection valve 11 has a swirl flow generating portion 132*a*, which is provided at the upstream side of the seat portion 134 and causes fuel introduced through the fuel introduction path 136 to swirl in the sliding direction of the needle 132. The swirl flow generating portion 132*a* is formed at the extremity of the needle 132. The swirl flow generating portion 132*a* has a larger diameter than that of the base side of the needle 132. The extremity of the swirl flow generating portion 132*a* seats on the seat portion 134. As described above, the swirl flow generating portion 132*a* is located at the upstream side of the seat portion 134 in the open or closed state.

The swirl flow generating portion 132*a* has a spiral groove 132*b*. The fuel introduced through the fuel introduction path 136 passes through the spiral groove 132*b*, whereby a swirl component is applied to the flow of fuel and the swirl flow of fuel is generated.

The in-cylinder fuel injection valve 11 has a swirl increasing portion 135, which is provided at the downstream side of the seat portion 134 and supplies the fuel to the injection aperture 133 while increasing the swirl speed of the swirl flow generated by the swirl flow generating portion 132*a*. The swirl increasing portion 135 is formed to have a decreasing inner diameter toward a minimum aperture portion located at the downstream side of the seat portion 134. The minimum aperture portion has the smallest inner diameter at the downstream side of the seat portion 134. In the present embodiment, the minimum aperture portion is the injection aperture 133. The minimum aperture portion is not limited to the opening of the injection aperture 133.

The swirl increasing portion 135 is formed between the seat portion 134 and the injection aperture 133, and accelerates the swirl speed of the fuel in the swirling state after the fuel passes through the swirl flow generating portion 132*a*. The rotation radius of the swirl flow generated by the swirl flow generating portion 132*a* is gradually reduced. The swirl flow enters into the area having the reduced radius, and has an increased swirl speed. The swirl flow having the increased swirl speed forms an air post in the injection aperture 133. The inner circumferential wall of the swirl increasing portion 135 has a curved surface that is convex toward the center side. Now, a description is given of the formation of the air post and the generation of fine air bubbles.

When the swirl flow accelerates in the swirl increasing portion 135, a strong swirl flow is formed from the injection aperture 133 to the inside of the swirl increasing portion 135, and a negative pressure is thus generated in the center around which the storing swirl flow rotates. Due to the negative pressure thus generated, air outside of the nozzle body 131 is sucked in the nozzle body 131. Thus, the air post is generated in the injection aperture 133. The air bubbles are generated at the interface between the air post thus generated and the fuel. The generated air bubbles mix in the fuel that flows around the air post, and are then injected, as an bubble mixed flow, together with the fuel flow on the outer circumference side.

At that time, the fuel flow and the bubble mixed flow are shaped into a cone of spray spreading from the center due to the centrifugal force of the swirl flow. The diameter of the cone-shaped spray is larger as the spray is farther away from the injection aperture, and the liquid film of the spray is therefore thinner. Finally, the cone-shaped spray is not maintained in the form of the liquid film, and is divided into parts. Thereafter, the sprays after dividing have smaller diameters due to the self-pressurizing effect of the fine air bubbles, and come to breakdown and finally to ultra fine sprays. As described above, the spray of fuel injected by the in-cylinder fuel injection valve 11 is atomized, whereby the rapid flame propagation in the combustion chamber is realized and stable combustion is performed.

As described above, the evaporation of fuel is accelerated by making an attempt on the ultra fine spray of fuel, whereby PM (Particulate Matter) and HC (hydrocarbon) can be reduced. Further, the thermal efficiency is improved. Furthermore, the breakdown takes place after the air bubbles are injected from the in-cylinder fuel injection valve, and the EGR erosion in the in-cylinder fuel injection valve 11 can be suppressed.

In the present embodiment, the port fuel injection valves 12, 22, 32 and 42 are the same as the in-cylinder fuel injection valves 11, 21, 31 and 41. However, the port fuel injection valves may be anther type of fuel injection valves. Similarly, the in-cylinder fuel injection valves 11, 21, 31 and 41 are not limited to the fuel injection valves of the type illustrated in FIG. 2, but may be another type of fuel injection valves as far as they are capable of emitting fuel containing air bubbles.

Next, a description is given, with reference to the drawings, of an exemplary control of the fuel injection device 1. The control of the fuel injection device 1 is implemented by the ECU 7.

At step S01, the ECU 7 obtains the temperature Tw of the cooling water (engine cooling water temperature) supplied to the engine body 1. At step S02, the ECU 7 determines whether the engine cooling water temperature Tw is lower than a predetermined threshold value Tw1. The threshold value Tw1 is used for determining whether the engine body 1 is now in condition for enabling the following control appropriately.

The threshold value Tw1 may be a value for determining whether the engine warm-up is complete.

If the answer to the determination at step S02 is No, the ECU 7 proceeds to step S03. At step S03, the ECU 7 increases the injection ratios of the port fuel injection valves. Specifically, a port injection ratio kpfi is set to "1". That is, in each cylinder, all of the requested fuel injection amount is injected from the corresponding one of the port fuel injection valves 12, 22, 32 and 42. The fuel injections from the in-cylinder fuel injection valves 11, 21, 31 and 41 are stopped. As a result, the in-cylinder fuel injection valves 11, 21, 31 and 41 have suppressed cooling effects by fuel, and have rapidly raised temperatures due to the receipt of heat from the combustion gas. Therefore, the in-cylinder fuel injection valves 11, 21, 31 and 41 are now in condition for stable fuel injection. The process of step S03 is repeatedly carried out until the answer to the determination at step S02 is Yes.

Figure 4A:
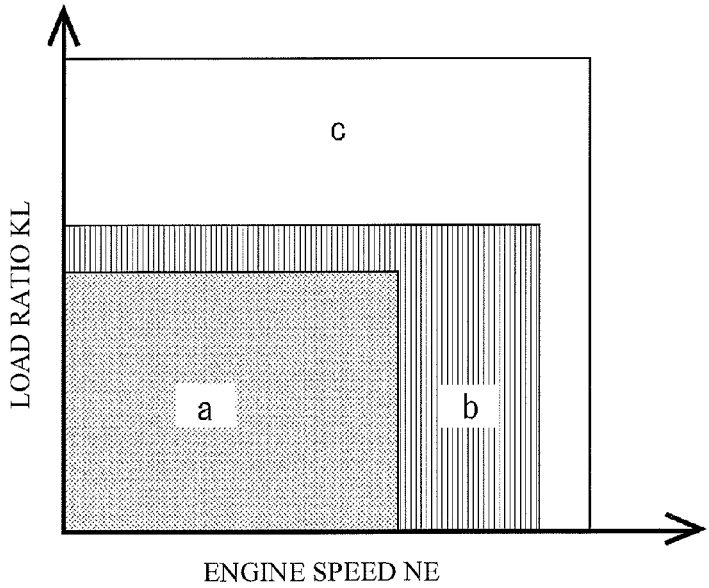
FIG. 4(A) illustrates an exemplary map for obtaining a target void fraction at the time of low temperatures of cooling water.
Figure 4B:
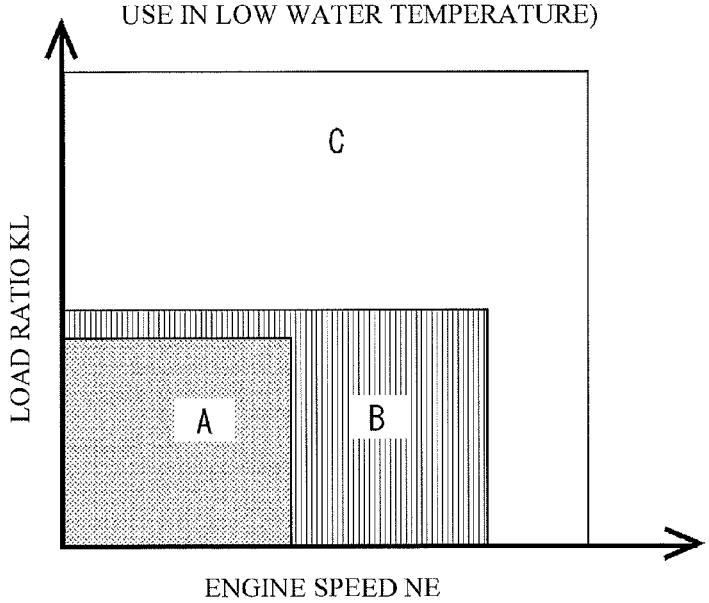
FIG. 4(B) illustrates an exemplary map for obtaining the target void fraction at the time of high temperatures of cooling water.

In contrast, if the answer to the determination at step S02 is No, the ECU 7 proceeds to step S04. At step S04, the ECU 7 calculates the target void fraction. Specifically, the ECU 7 refers to a map in order to determinate the target void fraction. The target void fraction is determined by a plurality of maps selected in accordance with the engine cooling water temperature. FIG. 4(A) illustrates an exemplary map used for obtaining the target void fraction at low water temperatures, and FIG. 4(B) illustrates an exemplary map used for obtaining the target void fraction at high water temperatures. The target void fraction is obtained from the engine load ratio KL and the engine speed NE. The map used at the low water temperatures is divided into three areas of a, b and c. The map used at the high water temperatures is divided into three areas of A, B and C. The values in the areas have relations a>b>c, A>B>C, a>A, b>B and c>C. The void fraction is set larger as the acceleration to the atomization is expected more considerably. Since the acceleration to the atomization is expected more considerably at lower water temperatures and at smaller load and lower speed, a larger void fraction is desired.

Figure 5:
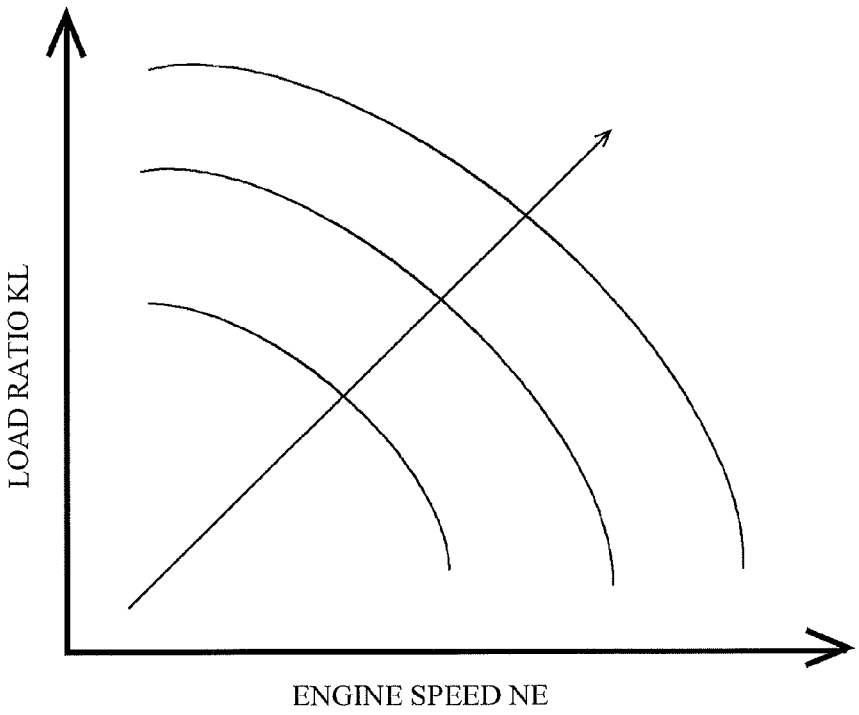
FIG. 5 illustrates an exemplary map for obtaining base fuel pressure.
Figure 6:
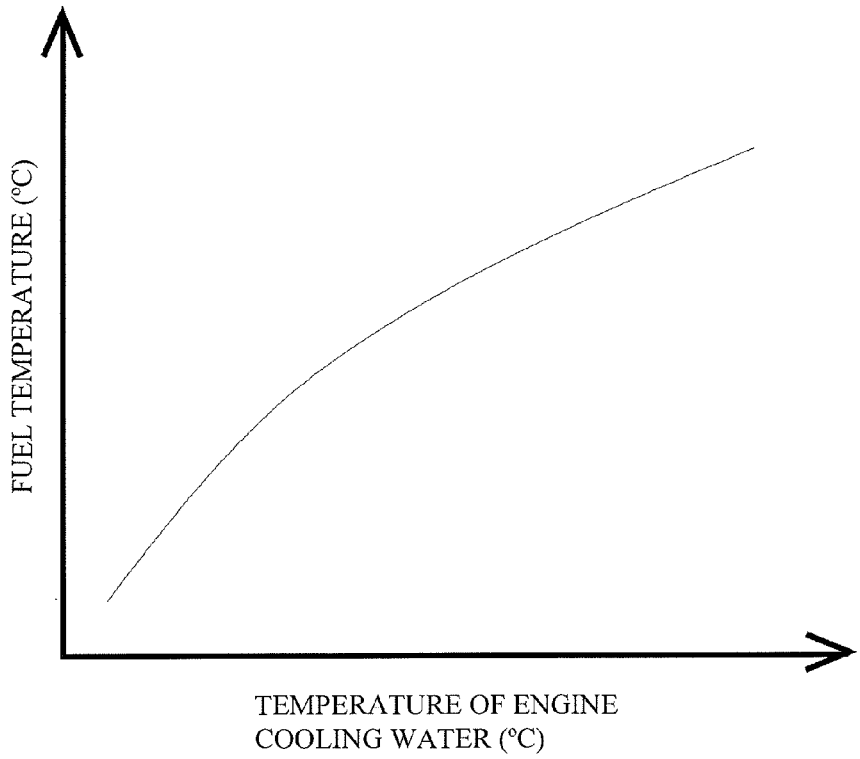
FIG. 6 is a graph that describes a relation between the temperature of cooling water and that of fuel.
Figure 7:
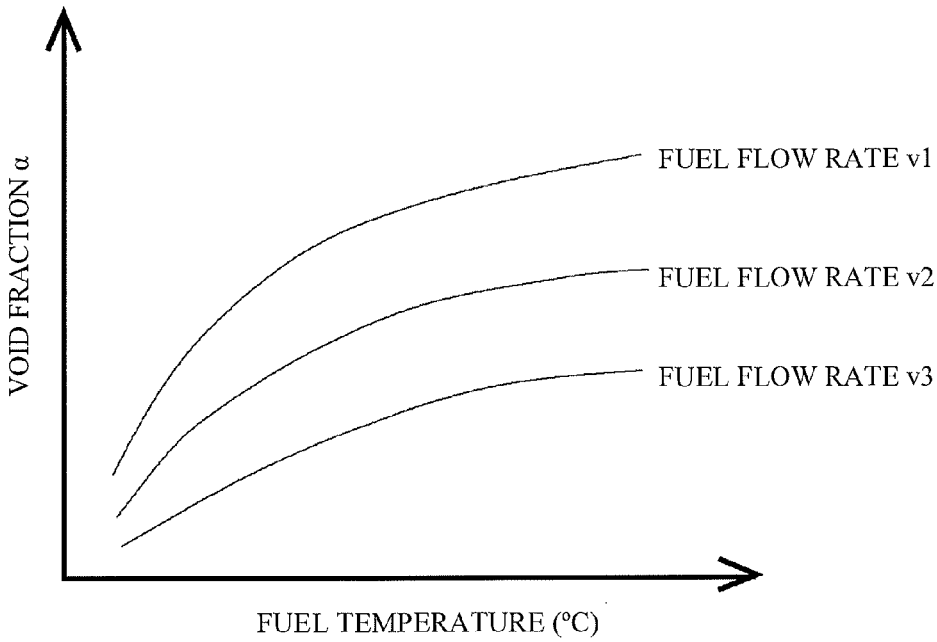
FIG. 7 is a graph that describes a relation between the fuel temperature and the void fraction for different fuel flow rates.

At step S05 subsequent to step S04, the ECU 7 calculates a base fuel pressure that is the base for setting the following fuel pressure, and a target fuel temperature. The base fuel pressure is calculated by referring to a map illustrated in FIG. 5. The base fuel pressure is calculated from the engine load ratio KL and the engine speed NE. The base fuel pressure is higher at higher load and higher engine speed. The target fuel temperature is calculated as a fuel temperature required to realize the target void fraction calculated at step S04. For example, the fuel temperature for realizing the target void fraction $\alpha$ is calculated. FIG. 6 is a graph that describes a relation between the engine cooling water temperature and the fuel temperature. FIG. 7 is a graph that describes a relation between the fuel temperature and the void fraction $\alpha$ for different fuel flow rates. The fuel temperature has a correlation with the engine cooling water temperature, and is lower as the engine cooling water temperature is lower. Referring to FIG. 7, the void fraction $\alpha$ is higher as the fuel flow rate is higher, and the void fraction $\alpha$ is higher as the fuel temperature is higher. Thus, in order to realize the same void fraction $\alpha$ for the different fuel flow rates, it is necessary to set the fuel temperature appropriately. Since the fuel flow rate changes in accordance with the fuel pressure, the target fuel temperature is set based on the base fuel pressure.

Figure 8:
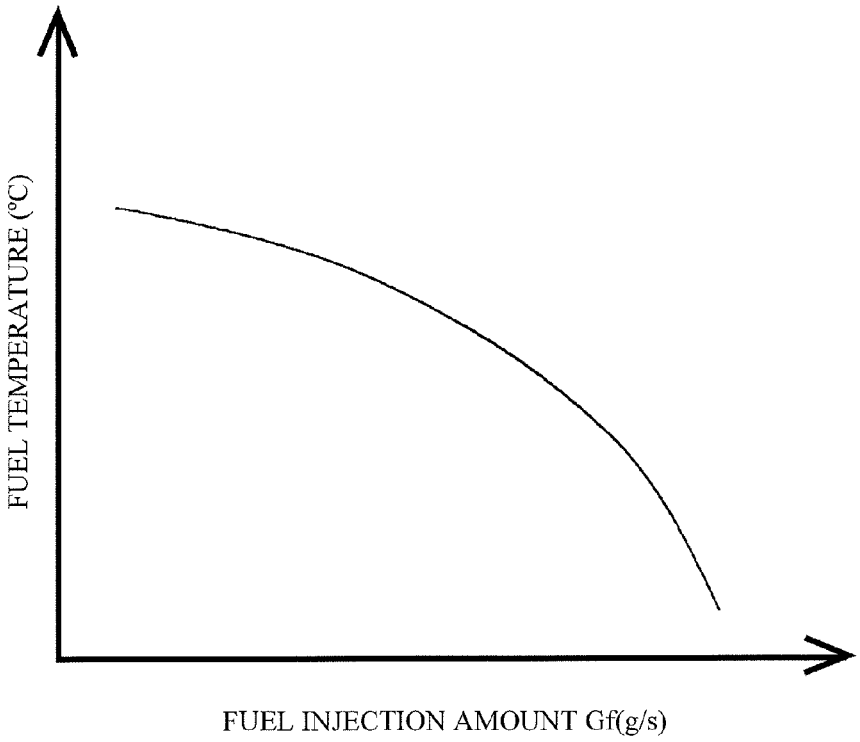
FIG. 8 illustrates an exemplary map for calculating the fuel temperature.

Next, at step S06, the ECU 7 obtains the real fuel temperature Tf. The real fuel temperature Tf is obtained by referring to a fuel temperature calculation map illustrated in FIG. 8. The fuel temperature Tf is calculated from the fuel injection amount Gf(g/s).

At step S07, the ECU 7 calculates a difference $\Delta$Tf in the fuel temperature between the cylinders. The difference $\Delta$Tf in the fuel temperature between the cylinders is the difference between the temperature of fuel to be injected from the first in-cylinder fuel injection valve 11 arranged closest to the fuel pump 6 and the temperature of fuel to be injected from the fourth in-cylinder fuel injection valve 41 arranged farthest from the fuel pump 6. This is employed by taking into consideration that the fourth in-cylinder fuel injection valve 41 arranged farthest from the fuel pump 6 have the longest heat receiving duration of time and is likely to have a considerable difference in the fuel temperature from the first in-cylinder fuel injection valve 11. The fuel temperature differences between the cylinders are prepared by obtaining those under different working conditions through an experiment and reflecting the fuel temperature Tf obtained at step S06 thereon.

Figure 9:
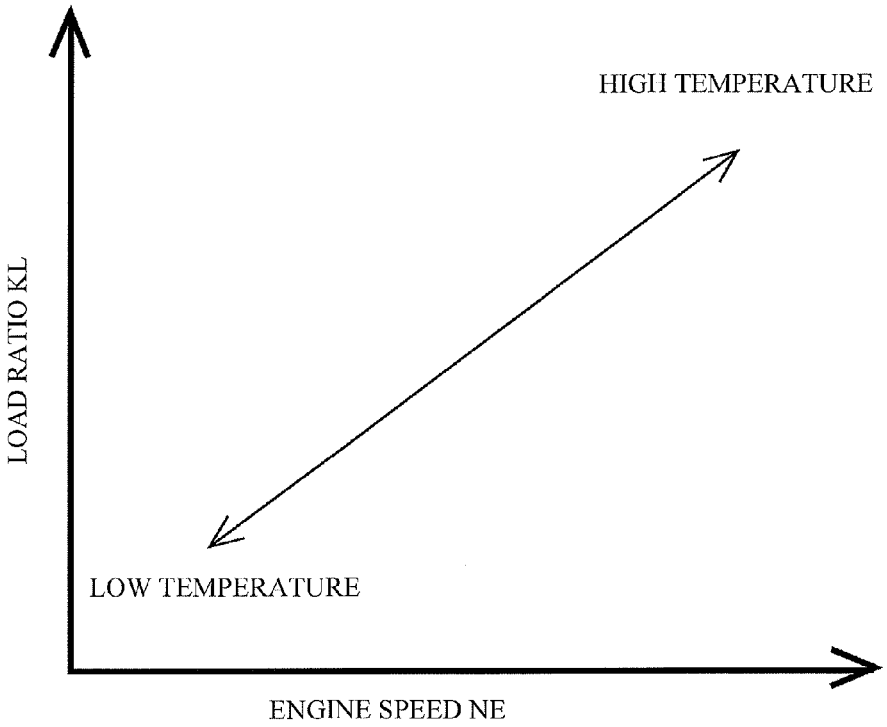
FIG. 9 is a graph that describes the fuel temperature in an in-cylinder fuel injection valve at low ratios of port injection.
Figure 10:
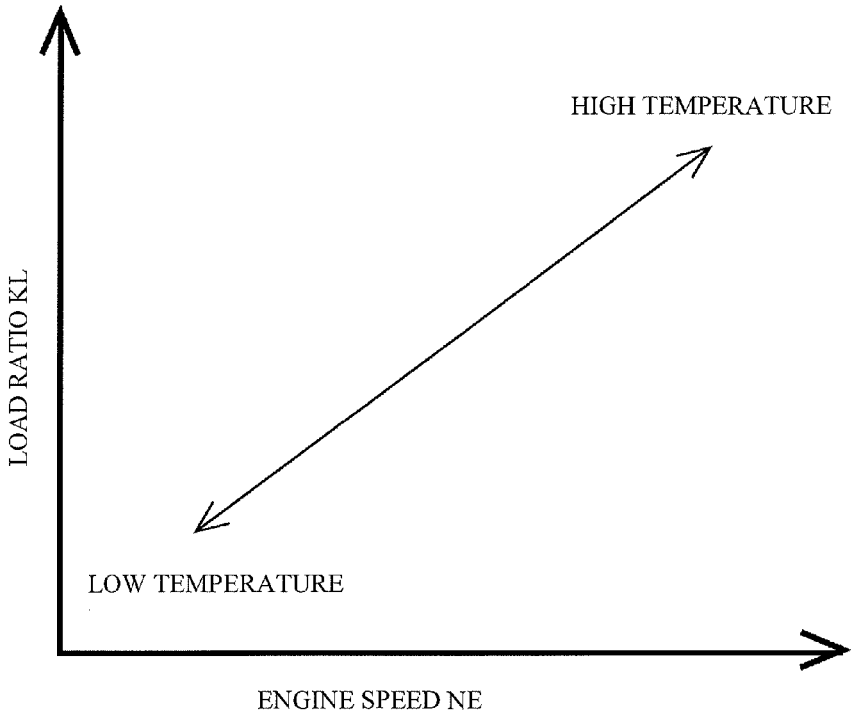
FIG. 10 is a graph that describes the fuel temperature in the in-cylinder fuel injection valve at high ratios of port injection.
Figure 11:
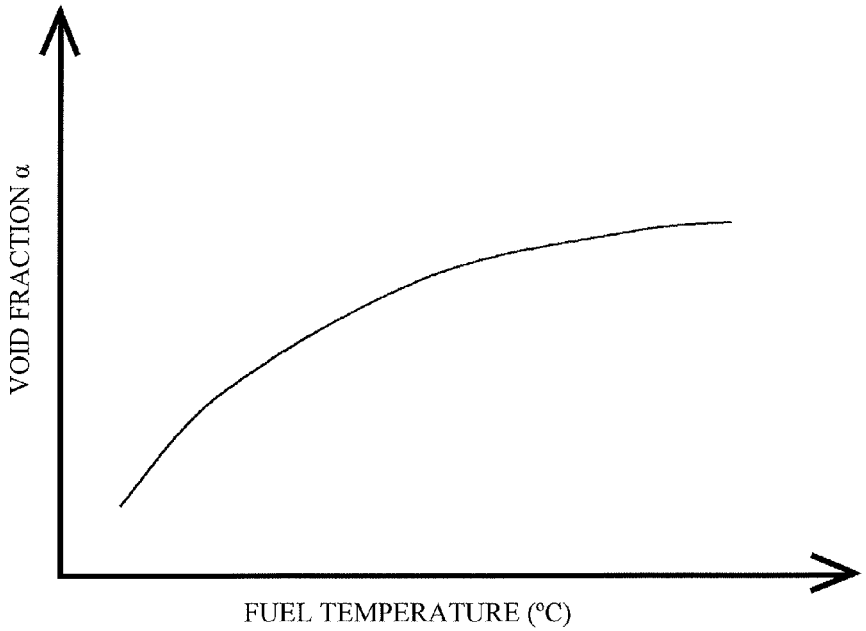
FIG. 11 is a graph that describes a relation between the fuel pressure and the void fraction.

At step S08, the ECU 7 determines whether the cylinder-to-cylinder difference in the fuel temperature calculated at step S07 is larger than a predetermined threshold value $\Delta$Tf1. If the cylinder-to-cylinder difference $\Delta$Tf is larger and the answer to the determination is YES, the ECU 7 proceeds to step S09. At step S09, the ECU 7 determines the port injection ratio kpfi for each cylinder. In contrast, if the cylinder-to-cylinder difference $\Delta$Tf is small and the answer to the determination is No, the ECU 7 proceeds to step S10. At step S10, the ECU 7 determines the port injection ratio kpfi common to all the cylinders. Now, a description is given, with reference to FIGS. 9 and 10, of a change of the fuel temperature made by changing the port injection ratio. As illustrated in FIG. 9, when the port injection ratio is small, the fuel temperature is lower as the engine is at larger engine load and higher engine speed. This is because the cooling effect is produced by an increased amount of fuel that is to be injected through the in-cylinder fuel injection valves. In contrast, as illustrated in FIG. 10, at high port injection ratios, the fuel temperature is higher at larger engine load and higher engine speed. This is because the cooling effect is not produced by a decreased amount of fuel to be injected through the in-cylinder fuel injection values. At steps S09 and S10, the ECU 7 controls the fuel temperature to the target fuel temperature calculated at step S05 by using the above relations. That is, the ECU 7 adjusts the temperatures of fuel to be injected from the in-cylinder fuel injection valves 11, 21, 31 and 41 in accordance with the fuel temperature in each cylinder of the engine body, and thus adjusts the void fraction of fuel.

At step S11, the ECU 7 adjusts a corrected void fraction. The ECU 7 calculates the corrected void fraction from the fuel temperature and the engine speed NE after the steps S09 and S10 are processed, the load ratio KL and the fuel pressure prior to correction, namely, the base fuel pressure.

At step S12, the ECU 7 calculates a void fraction deviation $\Delta\alpha$ from the target void fraction calculated at step S04 and the corrected void fraction calculated at step S11. Specifically, the ECU 7 calculates the difference between the target void fraction and the corrected void fraction.

At step S13, the ECU 7 calculates the target fuel pressure $f(\Delta\alpha)$ by using the void fraction deviation $\Delta\alpha$ obtained at step S12, and performs a fuel pump duty ratio control based thereon.

As described above, by adjusting the fuel temperature and the fuel pressure, it is possible to atomize fuel and secure the net amount of fuel.

Although the embodiment is equipped with the in-cylinder fuel injection valves 11, 21, 31 and 41 and the port fuel injection valves 12, 22, 32 and 42, if only the in-cylinder fuel injection valves 11, 21, 31 and 41 are provided, the control may be simplified. That is, the control about the fuel temperature may be omitted, and the desired void fraction is realized by adjusting the fuel pressure by the duty ratio of the fuel pump.

The above-described embodiments are just examples for carrying out the invention. Therefore, the present invention is not limited to these embodiments but may be variously changed or varied within the scope of the claimed invention.

DESCRIPTION OF REFERENCE NUMERALS

1 fuel injection device
2 engine body
#1 first cylinder
#2 second cylinder
#3 third cylinder
#4 fourth cylinder
11 first in-cylinder fuel injection valve
12 first-port fuel injection valve
21 second in-cylinder fuel injection valve
22 second-port fuel injection valve
31 third in-cylinder fuel injection valve
32 third-port fuel injection valve
41 fourth in-cylinder fuel injection valve
42 fourth-port fuel injection valve
5 delivery pipe
5*a*1~5*a*4 first branch pipe
5*b*1~5*b*4 second branch pipe
511 first adjustment valve
512 second adjustment valve
513 third adjustment valve
514 fourth adjustment vale
6 fuel pump
7 ECU
8 water temperature meter
101 first intake port
102 second intake port
103 third intake port
104 fourth intake port

The invention claimed is:

1. A fuel injection device comprising:

a fuel injection valve that is mounted in an engine body and injects fuel containing air bubbles; and void fraction adjustment means that changes a void fraction of the fuel that is to be injected from the fuel injection valve, wherein the void fraction adjustment means adjusts the void fraction of the fuel by changing temperature of the fuel to be injected from the fuel injection valve.

2. The fuel injection device according to claim 1, wherein the void ratio adjustment means increases fuel pressure of the fuel to be injected from the fuel injection valve when an increase of the void fraction is requested.

3. The fuel injection device according to claim 1, wherein the void fraction adjustment means increases the temperature of the fuel that is to be injected from the fuel injection valve when an increase of the void fraction is requested.

4. A fuel injection device comprising:

a fuel injection valve that is mounted in an engine body and injects fuel containing air bubbles; and void fraction adjustment means that changes a void fraction of the fuel that is to be injected from the fuel injection valve, wherein the void fraction adjustment means increases the temperature of the fuel that is to be injected from the fuel injection valve when the increase of the void fraction is requested.

5. The fuel injection device according to claim 4, wherein the void ratio adjustment means increases fuel pressure of the fuel to be injected from the fuel injection valve when an increase of the void fraction is requested.

6. The fuel injection device according to claim 1, wherein the void fraction adjustment means adjusts the void fraction by adjusting the temperature of the fuel to be injected from the fuel injection valve in accordance with the temperature of fuel in each cylinder of the engine body.

7. The fuel injection device according to claim 1, wherein the fuel injection valve includes an in-cylinder fuel injection valve and a port fuel injection valve, and the void fraction adjustment means adjusts the temperature of the fuel to be injected from the in-cylinder fuel injection valve by changing an injection ratio between the in-cylinder fuel injection valve and the port fuel injection valve.

8. The fuel injection device according to claim 7 wherein the void fraction adjustment means increases the injection ratio of the port fuel injection valve when the temperature of cooling water supplied to the engine body is lower than a predetermined threshold vale.

9. The fuel injection device according to claim 2, wherein the void fraction adjustment means increases the temperature of the fuel that is to be injected from the fuel injection valve when an increase of the void fraction is requested.

10. The fuel injection device according to claim 4, wherein the void fraction adjustment means adjusts the void fraction by adjusting the temperature of the fuel to be injected from the fuel injection valve in accordance with the temperature of fuel in each cylinder of the engine body.

11. The fuel injection device according to claim 4, wherein the fuel injection valve includes an in-cylinder fuel injection valve and a port fuel injection valve, and the void fraction adjustment means adjusts the temperature of the fuel to be injected from the in-cylinder fuel injection valve by changing an injection ratio between the in-cylinder fuel injection valve and the port fuel injection valve.

* * * * *